US005205306A

United States Patent [19]

Peterson

[11] Patent Number: 5,205,306

[45] Date of Patent: Apr. 27, 1993

[54] SPRAYING EQUIPMENT FOR REMOVING HAZARDOUS MATERIALS FROM OBJECTS

[76] Inventor: Mark D. Peterson, 1430 Cannell, Grand Junction, Colo. 81501

[21] Appl. No.: 568,210

[22] Filed: Aug. 16, 1990

[51] Int. Cl.[5] ..... B08B 3/02

[52] U.S. Cl. ..... 134/104.2; 134/199; 134/104.4; 285/176; 239/559; 4/569; 4/615

[58] Field of Search ..... 134/44, 104.4, 122 R, 134/199, 190, 172, 104.2; 239/545, DIG. 4, 567, 558, 559, 587, 588; 15/104.04; 285/177, 392, 353, 354, 386, 133.1, 12; 4/599, 567, 568, 569, 570, 601, 602, 603, 615, 616, 617, 618

[56] References Cited

U.S. PATENT DOCUMENTS

| | | | |
|---|---|---|---|
| 536,020 | 3/1895 | Ebert | 4/618 |
| 759,874 | 5/1904 | Fletcher | 239/567 X |
| 950,269 | 2/1910 | Youngs | 4/567 |
| 1,406,070 | 2/1922 | Patton | 239/567 X |
| 1,758,767 | 5/1930 | Taggart | 4/615 X |
| 1,867,634 | 7/1932 | Snyder | 134/199 X |
| 1,871,810 | 8/1932 | Lester | 285/12 |
| 1,982,518 | 11/1934 | Howard | 134/199 X |
| 2,161,047 | 6/1939 | Holden | 4/618 |
| 2,380,665 | 7/1945 | Morris | 4/567 |
| 2,483,789 | 10/1949 | Smith et al. | 4/567 X |
| 2,648,342 | 8/1953 | Yani et al. | 134/93 |
| 2,665,171 | 1/1954 | Stievater | 134/199 X |
| 2,689,577 | 9/1954 | Dunn et al. | 134/199 X |
| 2,703,579 | 3/1955 | Merancy et al. | 134/93 X |
| 2,754,834 | 7/1956 | Merancy et al. | 134/93 X |
| 2,858,555 | 11/1958 | Medovick | 134/199 X |
| 2,985,178 | 5/1961 | Christensen, Jr. | 134/199 X |
| 3,023,971 | 3/1962 | Milnous | 239/587 R X |
| 3,139,096 | 6/1964 | Harris | 134/199 X |
| 3,326,551 | 6/1967 | Clarke | 239/261 X |
| 3,353,546 | 11/1967 | Mahoney | 134/123 |
| 4,067,072 | 1/1978 | Izzi | 285/177 X |
| 4,076,175 | 2/1978 | Bert | 134/199 X |
| 4,142,257 | 3/1979 | Mace | 4/615 |
| 4,266,813 | 5/1981 | Oliver | 285/177 X |
| 4,299,245 | 11/1981 | Clapper | 134/170 X |
| 4,535,938 | 8/1985 | Lindabury, Sr. | 239/587.6 |
| 4,583,668 | 4/1986 | Maynard, Jr. | 285/177 X |
| 4,732,186 | 3/1988 | Nishikawa | 134/123 |
| 4,749,130 | 6/1988 | Utzinger | 239/567 X |
| 4,778,111 | 10/1988 | Leap | 239/567 X |

FOREIGN PATENT DOCUMENTS

| | | | |
|---|---|---|---|
| 37653 | 6/1909 | Australia | 134/199 |
| 313525 | 4/1989 | European Pat. Off. | 4/567 |
| 1087534 | 8/1960 | Fed. Rep. of Germany | 4/601 |
| 1272242 | 4/1968 | Fed. Rep. of Germany | 4/601 |
| 2262204 | 7/1974 | Fed. Rep. of Germany | 239/545 |
| 606164 | 6/1926 | France | 4/616 |
| 2393561 | 2/1979 | France | 4/618 |
| 327660 | 2/1958 | Switzerland | 4/567 |
| 312589 | 12/1971 | U.S.S.R. | 134/199 |
| 6436 | 5/1894 | United Kingdom | 4/601 |
| 10674 | 4/1902 | United Kingdom | 4/618 |

*Primary Examiner*—Frankie L. Stinson

*Attorney, Agent, or Firm*—Kenton L. Freudenberg; Maxwell C. Freudenberg

[57] ABSTRACT

A decontamination system for rinsing hazardous materials from victims or suited emergency personnel using hand held thin flat octagonal rings of square aluminum tubing having a plurality of radially inwardly directed nozzles for simultaneously spraying water inwardly toward all sides of the part of a person at the center of the ring in a pattern from each nozzle which is wide but confined to about the thickness of the ring. Each ring has two external diametrically opposed sockets for receiving telescoping handles for spraying movement by one or two assisting persons, or it may be manipulated by a user for self-spraying by being hand held or by being pulled down around the user from an elevated horizontal position in which it is supported by elastic cords within a tent frame structure. Multiple rings for a method of decontamination spraying using a system having two different sets of multiple stations, reserved for emergency personnel and for victims, receive individually controlled supplies of water from one manifold having a single female inlet connector fitting different sizes of fire hose. Each spray station has a separate collecting receptacle and all stations of the two-set system are in a larger collecting pool created by placing a large plastic sheet over a fire hose in a closed loop on a flat surface. A person is moved through successive stations of one set with the first station having soap selectively added to the spray by a controlled mixing device connected to the manifold. All rings, telescoping handles and a manifold for one two-set system may be packed as a kit in a single flat square bag.

38 Claims, 10 Drawing Sheets

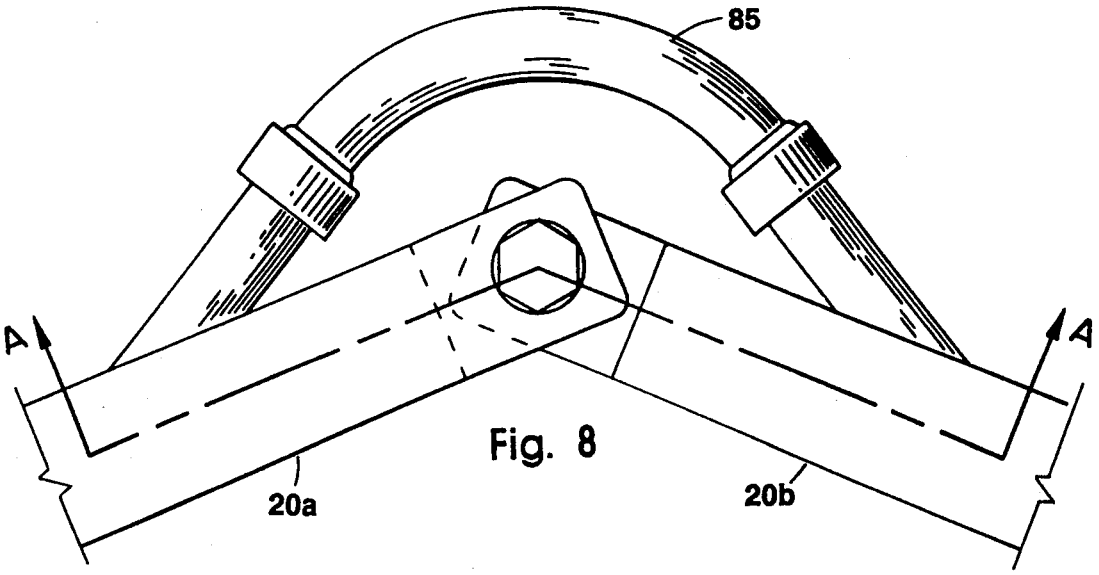
Fig. 8
Fig. 9
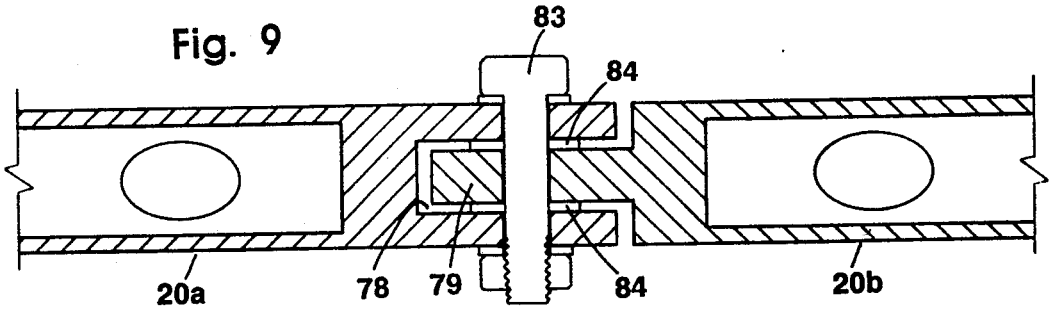
SECTION A-A
Fig. 10
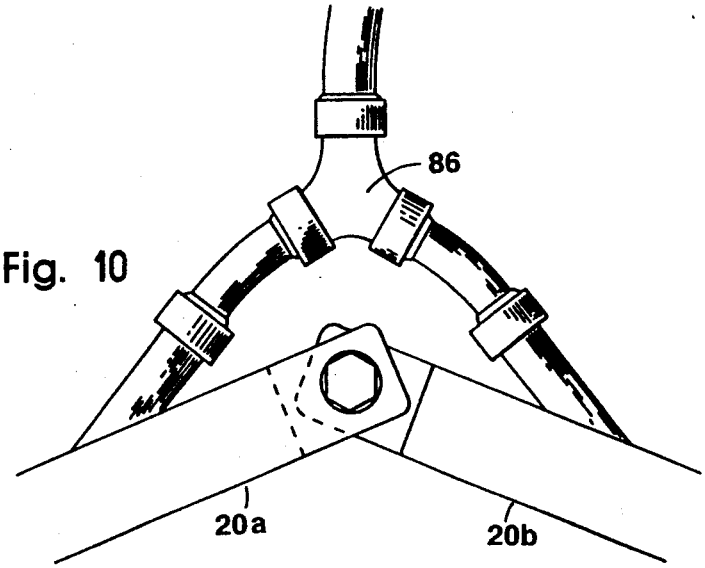

SPRAYING EQUIPMENT FOR REMOVING HAZARDOUS MATERIALS FROM OBJECTS

BACKGROUND OF THE INVENTION

Firefighters or other emergency personnel are commonly called to assist in emergency situations or at accident scenes in which danger to the individuals is created by the presence of any of a number of hazardous materials. Often the individuals responding to such emergencies are specially trained members of a "hazardous materials response team".

These materials typically include toxic, caustic or flammable chemicals and can be in virtually any form, including solids, liquids or gasses. To deal with such situations and to minimize or avoid exposure to these materials, the emergency personnel will typically don protective gear which is designed to be relatively impervious to the hazardous materials and which commonly includes breathing apparatus to create a sealed self-contained environment for the user. However, the wearer is still in danger of coming into contact with the hazardous material if the suit and/or related equipment is not properly decontaminated prior to either (1) the removal of the suit or equipment or (2) the reuse of the suit. These protective suits are typically relatively bulky and are made even more so by the breathing apparatus which is usually worn under the suit. Because of the bulkiness of such a suit and for general safety reasons decontamination of a protective suit has typically involved two person teams where one individual uses a liquid cleaning solution, usually comprising plain water or a water based soap or detergent solution, to rinse and scrub the exterior of the other's suit to dilute and/or remove any residue of the hazardous material. Dilution is effective when the concentration of a hazardous material can be reduced to the point where it no longer poses any threat of harm or injury to an individual.

While being generally effective, this procedure has the disadvantages of being relatively slow and time consuming, requiring an additional person to assist each individual to be decontaminated and requiring the assistant to be in relatively close contact with the contaminated individual and the material causing the contamination. Also, because of the time required to perform decontamination in this manner, the continuous flow of water results in a relatively large quantity of water being necessary to perform decontamination. Known prior art devices to accomplish decontamination have also included freestanding cage-like structures constructed from pipes or tubular material to surround an individual and direct a high-volume spray of water or other liquid toward him from a number of different directions. However, such devices have proven less than completely satisfactory due to (1) the large quantity of water which is required for their use, (2) their general lack of convenient portability and (3) the relative difficulty and time required in setting them up for use.

In contrast, the present invention provides for a method of decontamination utilizing specific hardware and is intended to overcome each of these weaknesses.

SUMMARY OF THE INVENTION

Part of the need for decontamination of personnel is for patients or victims who are exposed to hazardous materials at an accident site. Another significant part of this need is for decontaminating the suits of hazardous material team personnel who are working at an accident site. The present invention is intended to minimize the time required by a hazardous materials response team to set up a decontamination system and to make hazardous material decontamination of persons and objects quick and simple, as well as to allow an individual to effectively decontaminate himself without the assistance of another individual. Decreasing the time required for decontamination also minimizes the amount of water required for decontamination.

The invention comprises a method for quickly establishing an effective decontamination station or multiple stations and hardware for use in such a decontamination system including (1) an octagonal ring of a tubular construction wherein the tube is capable of conducting water or other fluid around its periphery to a number of inwardly facing nozzles spaced about its periphery to provide a spray pattern which completely encircles a person or object being sprayed at each station and (2) a manifold capable of being connected to multiple sizes of typical fire hose and providing a plurality of individually controllable outlets for normal size "garden" hose to feed the multiple stations used in a decontamination operation. The octagonal tubular ring allows a single individual to effectively rinse and decontaminate any portion of his protective suit without assistance, including those portions which he might otherwise have difficulty reaching. By providing a spray pattern which completely surrounds an individual, the time required to perform the decontamination procedure is greatly reduced. The octagonal tube is provided with extendable handles which are diametrically opposed to one another to allow the ring to be used to decontaminate an individual by another single individual or two individuals standing on opposite sides at a safe distance from the person to be decontaminated. By having all nozzles facing inwardly the amount of overspray can be minimized and the total volume of water necessary to cleanse the individual of contaminants may be also be minimized. The water supply to the ring sprayer can be provided with a feeder to automatically supply a soap or similar solvent to facilitate the cleaning effect of the fluid being used. A mild soap such as that sold as "Ivory Liquid" is commonly used for this purpose.

Generally, when dealing with an emergency situation it is necessary to set up a temporary station for the decontamination of individuals who may have been exposed to hazardous materials. Normal procedure dictates that this station be capable of collecting any waste water resulting from the process of decontaminating any workers, victims or objects since the material rinsed off may still have toxic or environmentally dangerous properties. Because time may be of the essence in performing decontamination, this decontamination area is preferably set up prior to the entry into an area in which any hazardous material may be encountered. The present invention provides such a method of relatively quick and simple setup of a decontamination station or stations. A large area for collection of the waste water or overspray is constructed by laying out a large fire hose into an elongated closed shape on a level surface and then laying polyethylene plastic sheeting over the hose and within the closed area to create a large shallow watertight bowl-shaped pool area with the raised plastic sheeting over the hose serving as a raised lip around the area. A number of smaller pools are placed within this area and are used in sequence for the actual decontamination process. The larger area defined by the fire hose is used only for trapping overspray and waste water not contained in the smaller pools. The free end of the hose is attached to a manifold with individually controllable outlets for a plurality of smaller "garden" hoses, each of which can be directed to an individual station or portion of the multiple decontamination station system to provide water to a spray ring as previously described.

It is an object of the invention to provide a method which is quick and simple for setting up one or more decontamination stations in which all waste material and overspray can be readily contained.

It is also an object of the present invention to provide a spray ring for use at a decontamination station large enough to encircle an individual for the purpose of providing spray simultaneously from a variety of different directions.

It is another object of the present invention to provide a spray ring capable of encircling an individual wearing a protective suit and breathing apparatus where the spray ring is provided with internal handles for the purpose of allowing the individual to readily grasp and manipulate the ring without assistance.

It is also an object of the present invention to provide a spray ring large enough to encircle an individual wearing a protective suit and breathing apparatus for the purpose of providing spray simultaneously from a variety of different positions where the overall shape of ring is polygonal with flattened or straightened sides of sufficient length to provide non-rolling stability when it is resting on the ground surface and is partially supported by an individual user.

It another object of the present invention to provide a portable decontaminating spray ring with an extendable handle or handles so that the ring is manually operable and supportable by an individual or individuals other than one being decontaminated at some distance from that individual.

It another object of the present invention to provide a mobile spray ring which is manually operable to pass over the body of a person and which is capable of being opened to encircle a person or object supported in a horizontal position as, for example, when on a stretcher.

It another object of the present invention to provide a manifold which allows a plurality of individual controllable water lines to be fed by a single larger fire hose, wherein the manifold is provided with a female fitting which allows various commonly used sizes of fire hose with male fittings of different sizes to be secured thereto.

Another object of the invention is to provide a suspended spray ring supported by elastic cords from an elevated frame and which a person can pull down around himself and controllably release for automatic return to the elevated position and to use the frame for support of a tent-like covering to protect the spraying operation from windy conditions.

DESCRIPTION OF THE DRAWINGS

FIG. 8 is a plan view of detail of the hinge assembly of the embodiment of FIG. 2.

FIG. 9 is a cross section taken at A—A of FIG. 8.

FIG. 10 is detail of an alternative hose coupling for use with the embodiment of FIG. 2.

DESCRIPTION OF THE PREFERRED EMBODIMENT

Figure 12:
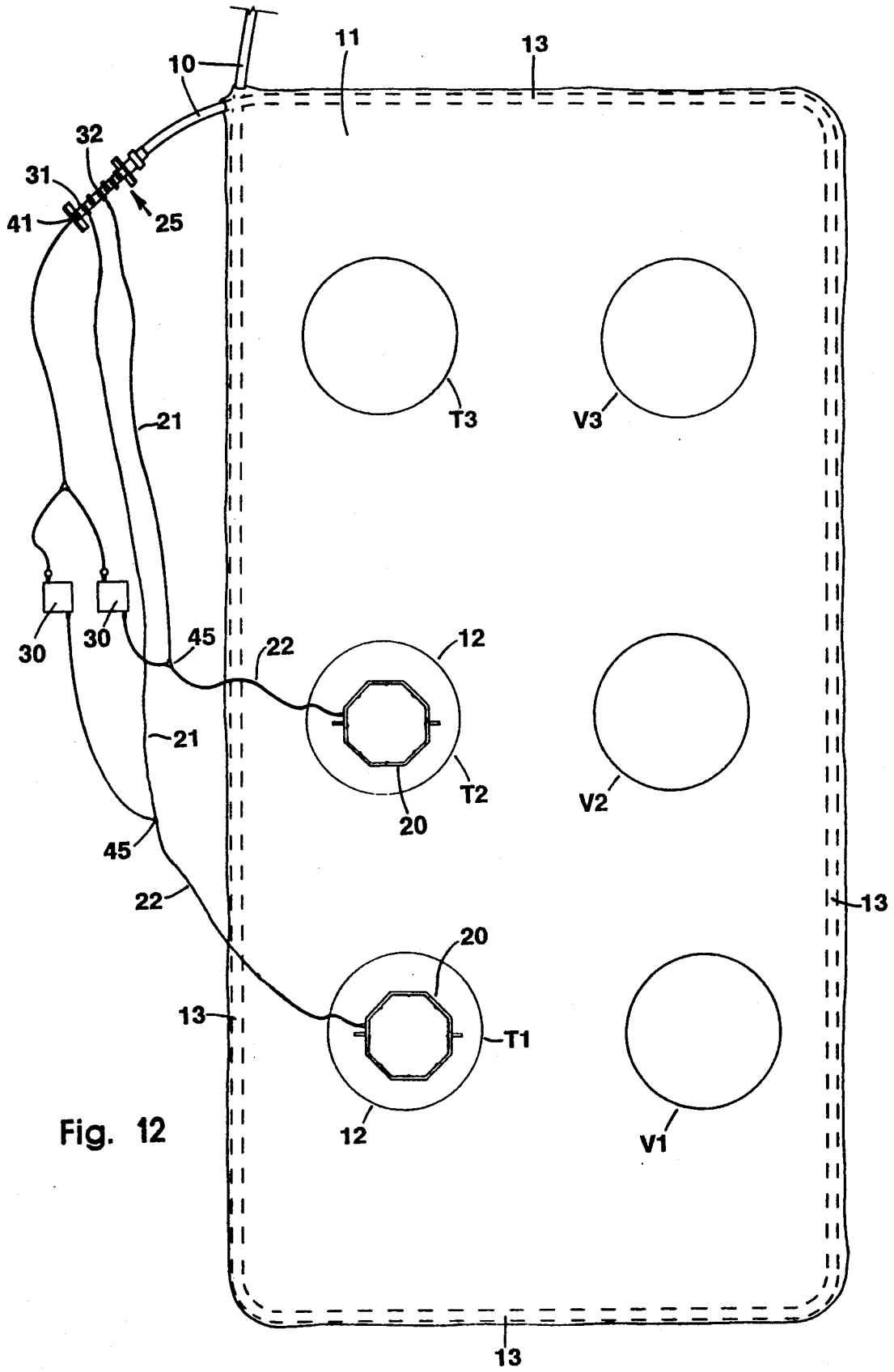
FIG. 12 is a plan view showing the layout of an area for multiple decontamination stations where the area is defined by a plastic sheet with a raised lip formed by a fire hose and further showing the spray ring layout of one such decontamination station.
Figure 18:
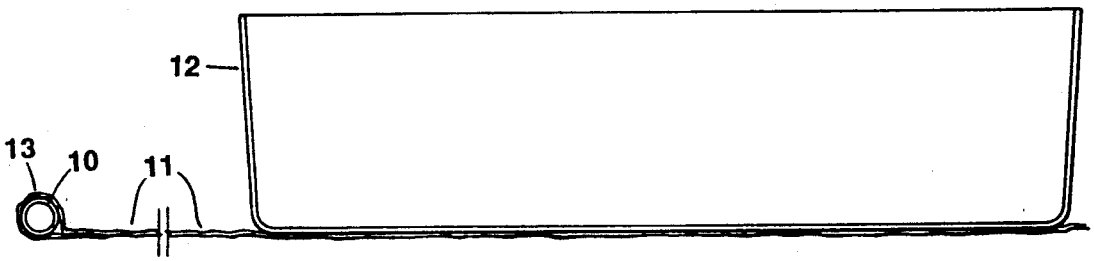
FIG. 18 is a cross sectional view of a pool for a decontamination station set in an area defined by a linear of plastic sheet lined within a raised lip formed by a fire hose.

A typical decontamination system using the present invention is depicted in FIG. 12 where a loop of a 2½ inch fire hose 10 is formed to define on a flat level ground surface an approximately 25 by 50 foot rectangle. This loop is covered with a large plastic sheet 11 forming a peripheral dam which will catch and retain most of the spray residue which is not caught by six individual pools 12, a representative one of which is shown in the drawing with its respective spray ring, set up within the perimeter of the fire hose loop and on top of the plastic sheet 11. The cross sections of FIG. 18. shows detail of the perimeter of the decontamination area where the edge of the plastic sheet 11 is wrapped over the top of the hose 10 from the inside of the covered area, then back underneath the hose from the outside. The hose 10 forms both a raised lip 13 for the plastic sheet to contain any overspray or spilled liquid and a perimeter weight to hold the sheet in place. The six pools 12, each set up as shown at T2 in FIG. 12, are set up in two groups of three pools. The pools are designated as T1, T2 and T3 (for emergency team personnel) and V1, V2 and V3 (for victims) respectively as shown in FIG. 12. A spray ring 20 as described further below is provided at each of the six pools and the decontamination liquid therefor is supplied by ¾ inch hoses 21, 22 from an outlet of an elongated liquid conducting and distributing manifold device 25 which has one end connected to the end of the fire hose. The manifold has three outlet connections for the ¾ inch hoses at each horizontal side thereof and a seventh outlet toward its other end which is provided for supplying liquid to a soap dispenser 30 as described hereinafter.

Figure 7:
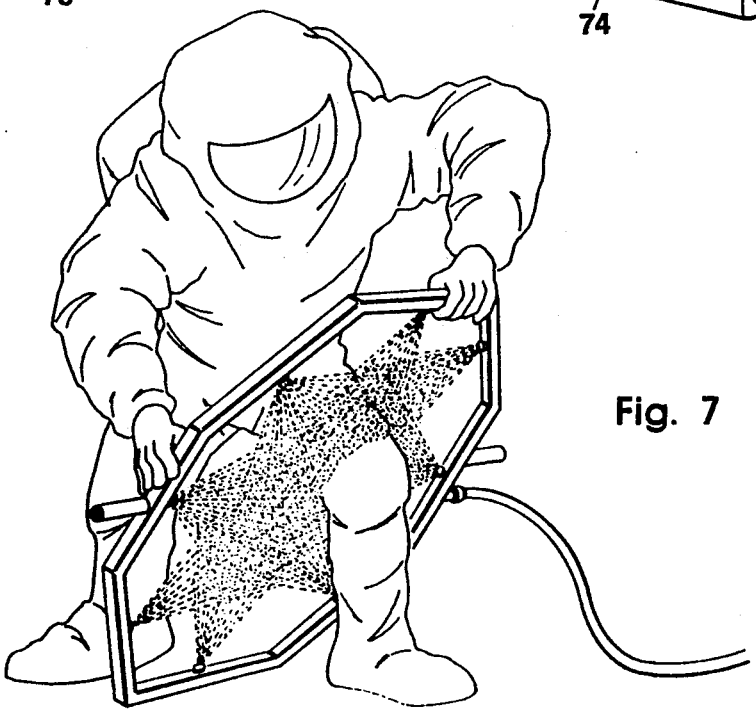
FIG. 7 shows the spraying device of the preferred embodiment being operated by an individual to decontaminate himself.
Figure 16:
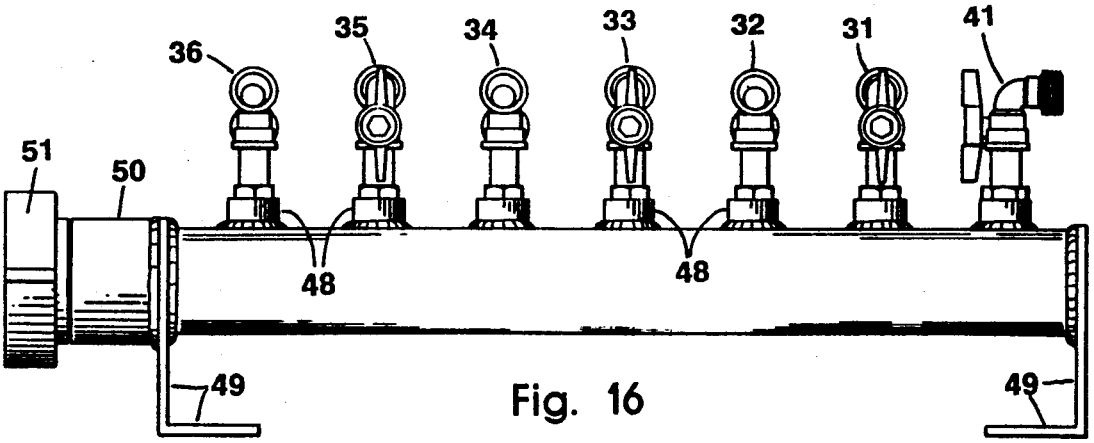
FIG. 16 is a side view of the manifold of the preferred embodiment.
Figure 17:
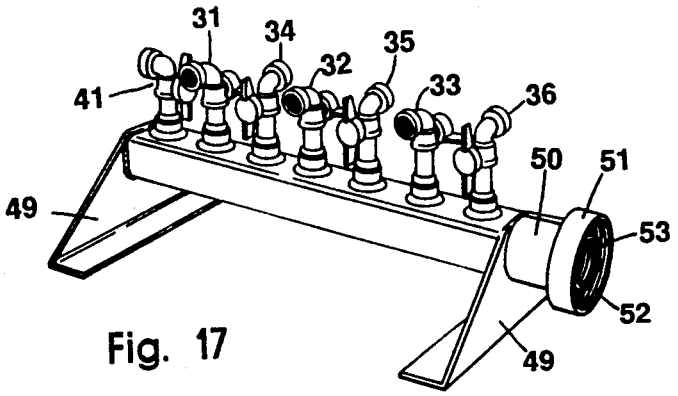
FIG. 17 is a perspective view of the manifold of the preferred embodiment.

Referring to FIGS. 12, 16 and 17, preferably valves 31, 32 and 33 having horizontally and laterally facing outlets on one side of the manifold are connected to supply spray rings at pool stations T1, T2 and T3 respectively and valves 34, 35 and 36 having horizontally and laterally facing outlets on the other side of the manifold are connected to supply spray rings at pool stations V1, V2 and V3. Each of the valves is a ball valve having a manipulating handle lever which can be easily operated by a person wearing a hazardous materials suit through a partial turn of the handle lever to completely open the valve structure to selectively control the supply of cleaning liquid at one or more spraying stations. Typically the stations T1–T3 and V1–V3 corresponding to the six spray rings are kept in two groups with the T1–T3 stations kept free for emergency team personnel and the V1–V3 stations used primarily for other victims who require decontamination spraying. The subscripts 1, 2 and 3 for the team (T) or victim (V) stations denote the order in which the person is sequentially moved for decontamination. At the first station, and perhaps the second station, soap is available for injection into the spray ring supply line and brushing may be performed at this station to maximize dilution and removable of the hazardous material. The persons being treated are sequentially moved to stations two and three to complete the dilution spraying. Essentially all of the spray at each of the stations is contained within the respective pools 12 which may hold up to 170 gallons each. Since the person being sprayed is standing in the pool, the build-up of the water that is partially contaminated in the pool may expose the legs of the person being treated to some contamination, but the ability to manipulate the spray ring is such that it can be moved over the person's leg as he steps from the pool to maximize the dilution of any hazardous material on the legs as shown in FIG. 7.

Figure 19:
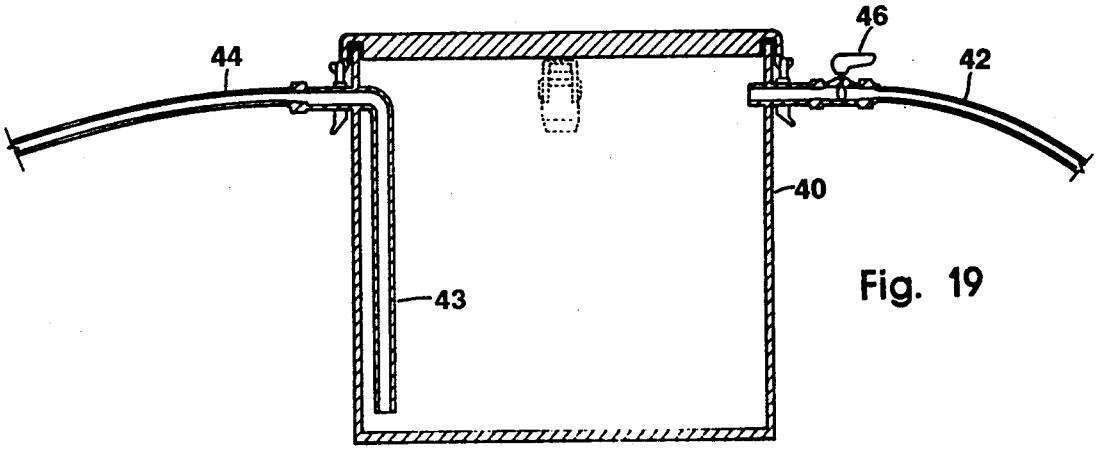
FIG. 19 is a cross sectional view of a container used to provide soap or solvent to the feed lines of a decontamination station.

Soap may be injected into the supply line hoses 21, 22 for the first station by supplying water to a closed five gallon tank 40, having a clamped pressure tight lid, as seen in FIG. 19, from a hose connected to the end outlet valve 41 on the manifold and providing the water therefrom to a valve-controlled inlet connection 42 at an upper level of the tank. The supply of water into the tank causes soap mixture which initially fills the tank to be forced out of the tank from a lower point therein via a pipe 43 extending from the lower point to an outlet connection 44 from which the soap mixture flows by a hose into a Y connection 45 for injection into the spray ring supply hose 22 for the ring 20 at the first station T1 or V1. The tank inlet has a control valve 46 and the outlet from the tank may be split to supply each of the stations T1 and V1 through an appropriate downstream control valve in each line between the soap dispenser 30 and line 22 and nearer to the spray rings 20, respectively. When any valve in the soap line is turned off it shuts off only the soap and the liquid being supplied to the respective station spray ring 20 via lines 21, 22 may continue to flow without any injection of soap.

The outlets 31–36 in the two sets of valves on the manifold are staggered on opposite sides to correspond to the arrangement of rings or stations controlled thereby and to improve the convenience of access to secure the hoses and to operate the valve levers.

The manifold 25 is formed by a generally square tubing section having female fittings 48 thereon into which male threaded ends of the seven outlet valves 31–36 are threaded. By dividing the six valves which supply the respective rings into two groups the valves which supply the T or V sets of decontamination stations are readily identified at the manifold and the six hoses therefrom are disposed to extend away from the horizontal outlet connections of the manifold valves 31–36 and alternately on opposite sides not only to simplify the connection of the hoses and provide convenient access to the valve actuating levers, but also to stabilize the manifold on its two footed supporting base members 49 when the manifold is in use. The base members 49 of the manifold are generally triangular plates extending downwardly in parallel planes perpendicular to the square tubular portion of the manifold with each plate having a horizontal flange or foot at the bottom to provide a supporting surface under the manifold keeping the fitting and valve parts of the manifold spaced from the supporting surface for cleanliness and more convenient access.

Figure 14:
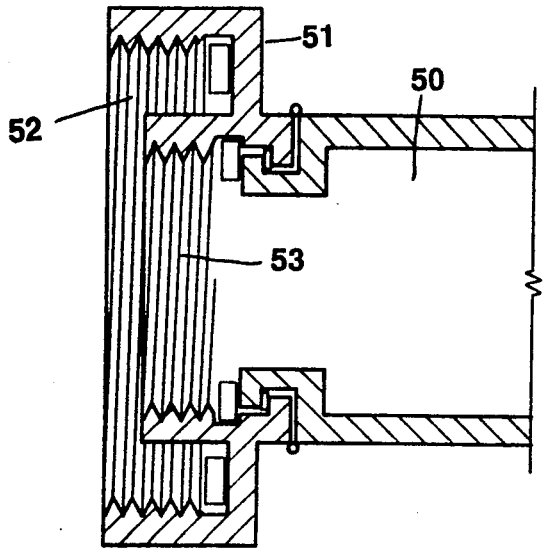
FIG. 14 is a cross sectional view of the fire hose connector used on the manifold of FIG. 16 and showing coaxial double female threads in a fitting to mate with two sizes of male threads.
Figure 15:
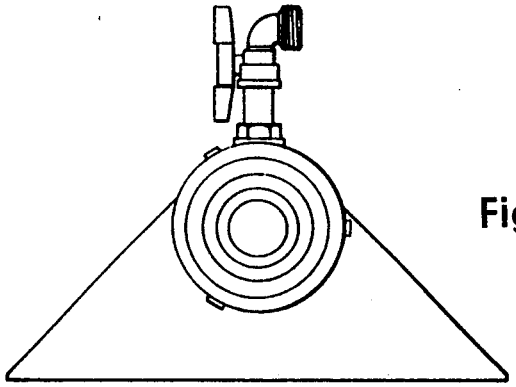
FIG. 15 is an end view of the manifold of the preferred embodiment showing the multiple size hose connection.

The inlet end or port 50 of the liquid conducting and distributing manifold device 25 has a unique double female rotatable fitting 51 shown in cross section in FIG. 14. This fitting is similar to a typical rotatable female fitting on the end of a fire hose, but is made with two sets of female threaded connections 52, 53 which are part of the same integral rotating end portion 51 of the manifold. The larger diameter female threaded connection 52 extends axially and outwardly beyond the end of the smaller threaded connection 53 and is of a size to fit the standard size male threaded fitting on the end of a standard 2½ inch fire hose. The smaller female threaded portion 53 of the double threaded head is located completely within the larger threaded portion 52 with its outer end recessed within the end of the head and will receive the standard size male threaded fitting common to standard 1½ and 1¾ inch fire hoses. Thus the double threaded head may be readily used to connect the manifold to any standard 1½, 1¾ or 2½ inch hose. The inlet port fitting 51 is rotatable relative to the port 50 which constitutes both an outlet port from the fitting 51 and the inlet port for the manifold device 25, thus enabling the fitting 51 to be threaded onto a fire hose male fitting without rotating the manifold device 25. Of course, the manifold threads must be selected to have the same type of standard or fine threads being used on the hose used by the decontamination team.

As seen in FIG. 14, the rotatable fitting 51 has at the inner end of each set of large and small diameter threads 52 and 53 a conventional transversely extending sealing gasket of any suitable well-known rubber-like material.

As is well known, the gaskets are self retaining in the positions shown when no male hose fittings are in place. When the rotatable fitting 51 is screwed onto a smaller male hose fitting via threads 53, the end of the male hose fitting will be tightly pressed in a conventional manner against the innermost gasket over the small annular gap at the rotating connection and the fitting 51 will be urged by the threads axially in the outward direction to force the radially-extending relatively rotating surfaces which face each other between the manifold body and the fitting 51 into tight fitting sealing engagement with each other, or against a friction-reducing washer therebetween, to provide means for preventing external escape of pressurized liquid through either the threaded connection or through the rotatable connection between the fitting and the port 50 of the manifold 25. Similarly, when a larger diameter threaded male fitting is secured to the manifold by threads 52, the outermost gasket is tightly pressed against the end of the annular recess which the male fitting to prevent external leakage along the threads 52. However, in this case the the fitting 51 is urged outwardly by the water pressure in the manifold to force the above described relatively rotating facing surfaces toward each other, and water pressure holds the innermost gasket against the small annular gap at the rotating connection to similarly seal the rotatable connection against external leakage.

Figure 1:
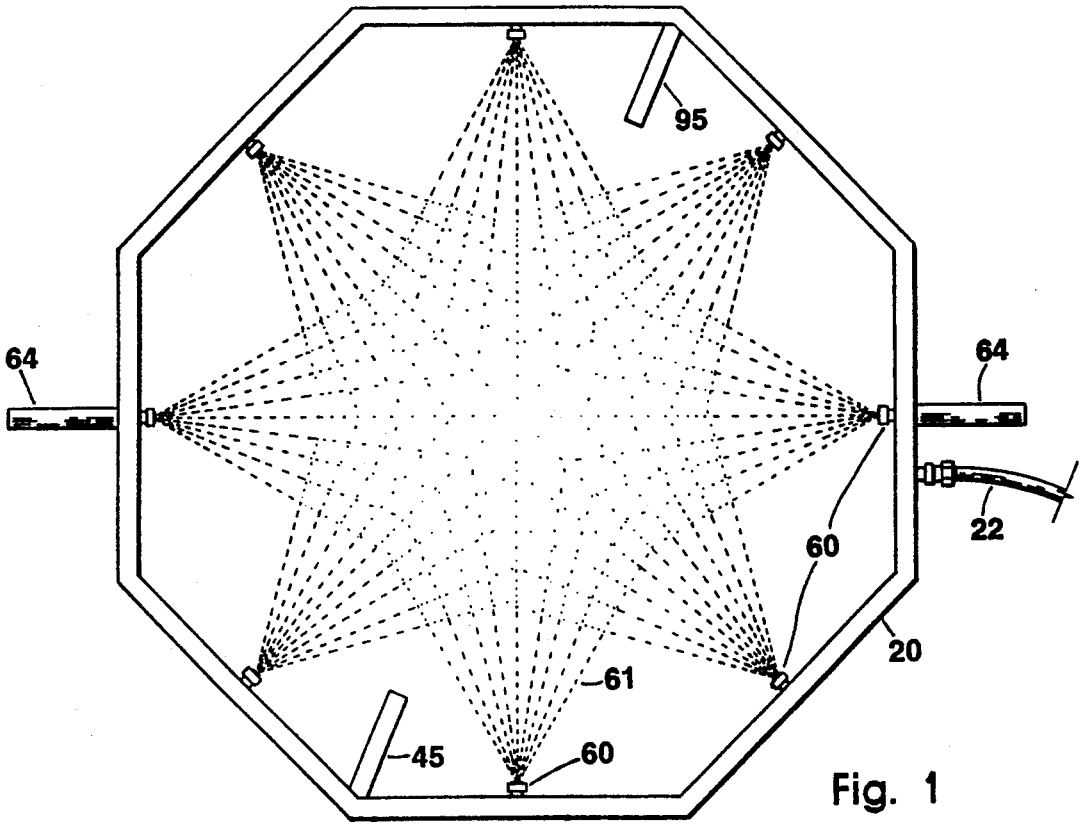
FIG. 1 is a plan view of the device of the preferred embodiment as it would appear in use showing the spray pattern created by the multiple spray nozzles.
Figure 2:
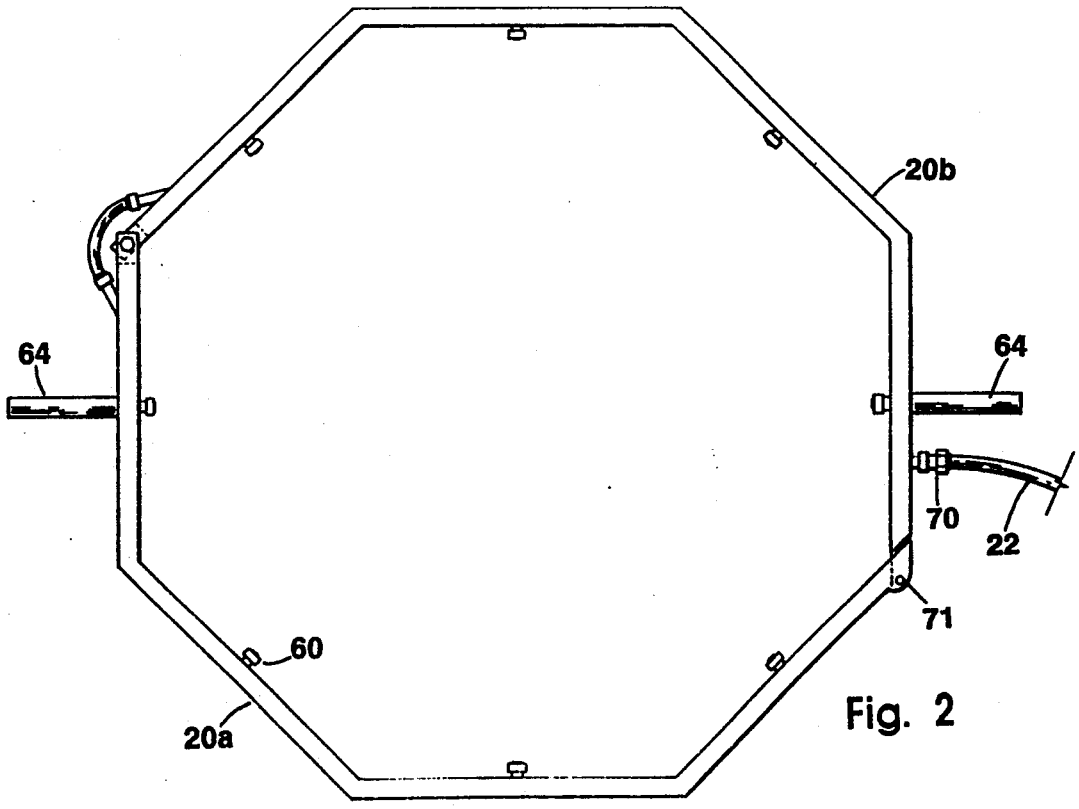
FIG. 2 is a plan view of an alternative embodiment in which the ring is provided with a hinge and latch which allow it to be opened.
Figure 3:
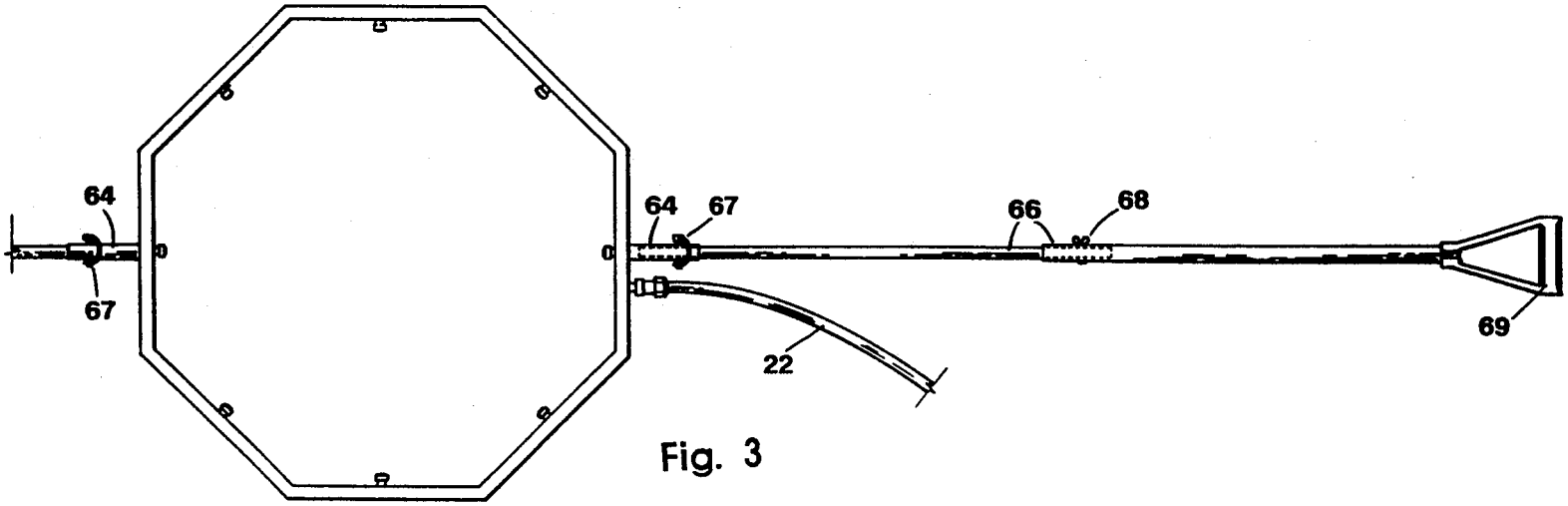
FIGS. 3 and 4 are plan views of the device of the preferred embodiment showing detail of the extendable handles.
Figure 4:
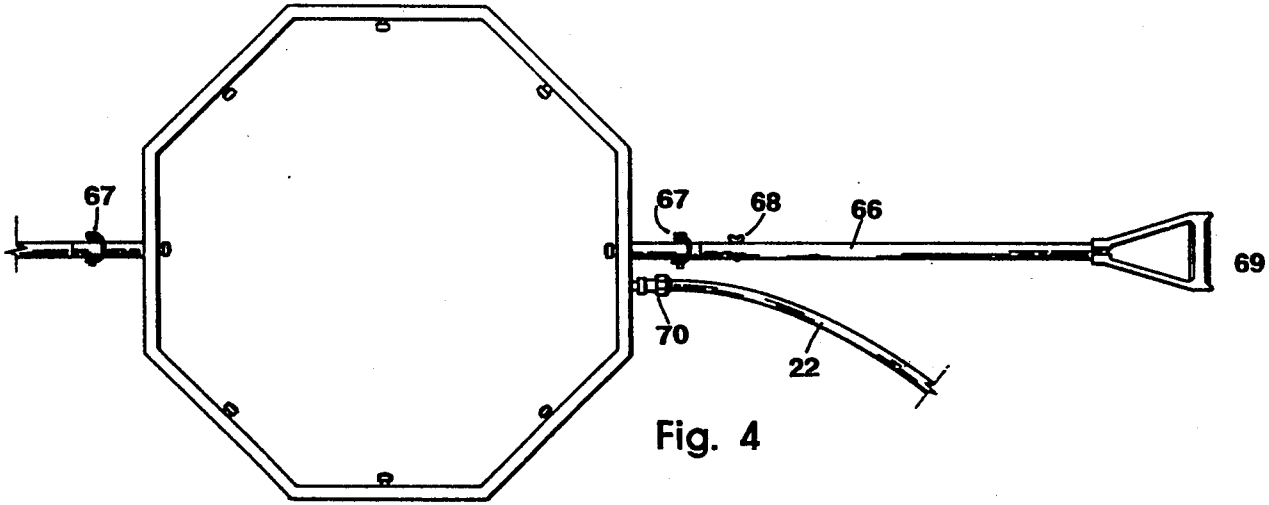
Figure 11:
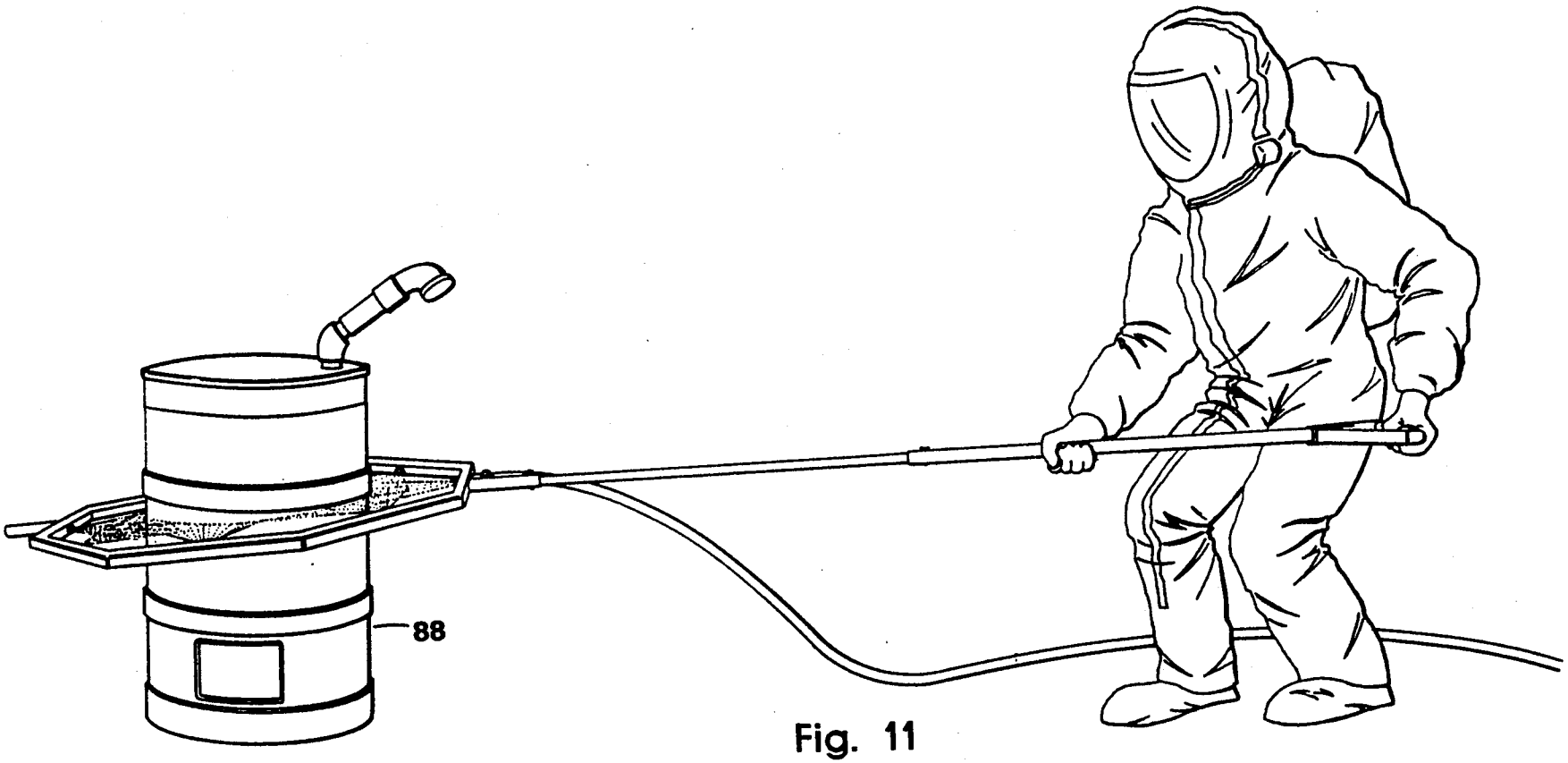
FIG. 11 shows the spray ring of the preferred embodiment as it may be used to decontaminate a chemical drum.

As seen in FIG. 1, the spray ring 20 itself is made from 1" square aluminum tubing in the shape of a regular octagon approximately 18 inches on each side and hollow around the full circumference of the ring. The sides of this regular polygon are connected at each of its corners to form obtuse angles of 135 degrees at the inside of the polygonal ring and in the plane thereof. At the center of the flat inner face of each straight side of the octagon is a threaded male fitting welded in place and receiving a nozzle 60, selected to direct a flat fan-patterned spray 61 toward the center of the ring and generally in the plane of the ring over an angle of approximately 80 degrees. The nozzles provide a low rate of flow in a concentrated flat essentially peripherally continuous spray pattern on the surface of an object or person within the ring for impingement of cleaning liquid at all outwardly exposed surfaces of the object or person therein. There are only several nozzles around the ring, eight in the illustrated embodiments of FIGS. 1 and 2, which are received in the respective fittings welded in a corresponding small number of holes in the inner face of the ring. Such nozzles 60 are commerically available for a variety of spray patterns for the purpose of spreading chemicals from airplanes as when "crop dusting." Two opposing sides of the octagon are each provided with a perpendicular outwardly extending round tubular handle socket 64 approximately 1 inch in diameter for tightly receiving one end of a readily manually attachable and detachable extendable handle 66, as seen in FIGS. 3 and 4. Each handle is secured in place by a removable pin 67 passing diametrically through a handle portion and its corresponding handle socket. The handle comprises two concentric telescoping tubular portions of similar length secured together by a removable threaded bolt 68 and nut passing diametrically through mating holes in each portion. At least one handle portion is provided with a plurality of sets of such holes, providing for at least two handle lengths ranging from 42 to 66 inches, including a normal shortened handle length as shown in FIG. 4 and an extended handle length as shown in FIG. 3. The outer telescoping tube has a 1 inch O.D. and the inner tube which fits closely therein has a $\frac{7}{8}$ inch O.D. To facilitate the manipulation of the device when using one or both handles, each handle is provided with a hand grip 69 at an end away from the ring. In use, to keep the user(s) at a distance from the ring and an object or person therein being sprayed, the ring is supportable by either handle along as as illustrated in FIG. 11, or by using both handles, one on each side of the ring.

Figure 6:
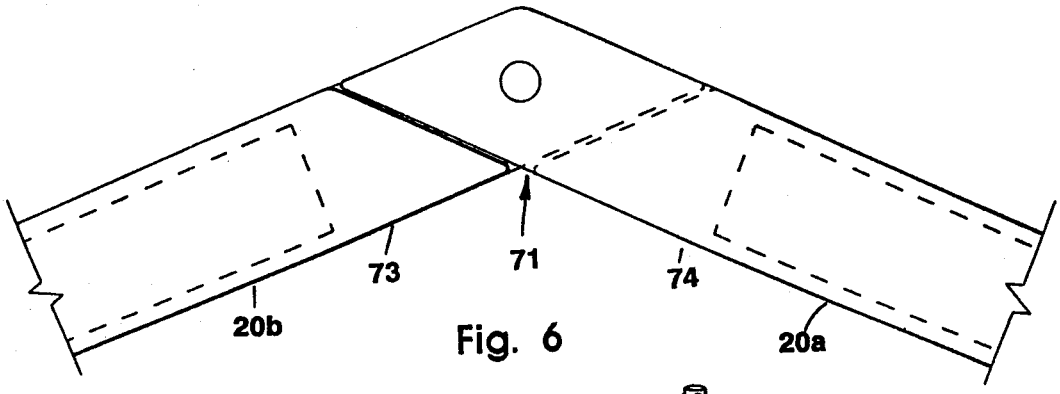
FIG. 6 is a plan view of detail of the latch assembly of the embodiment of FIG. 2.
Figure 5:
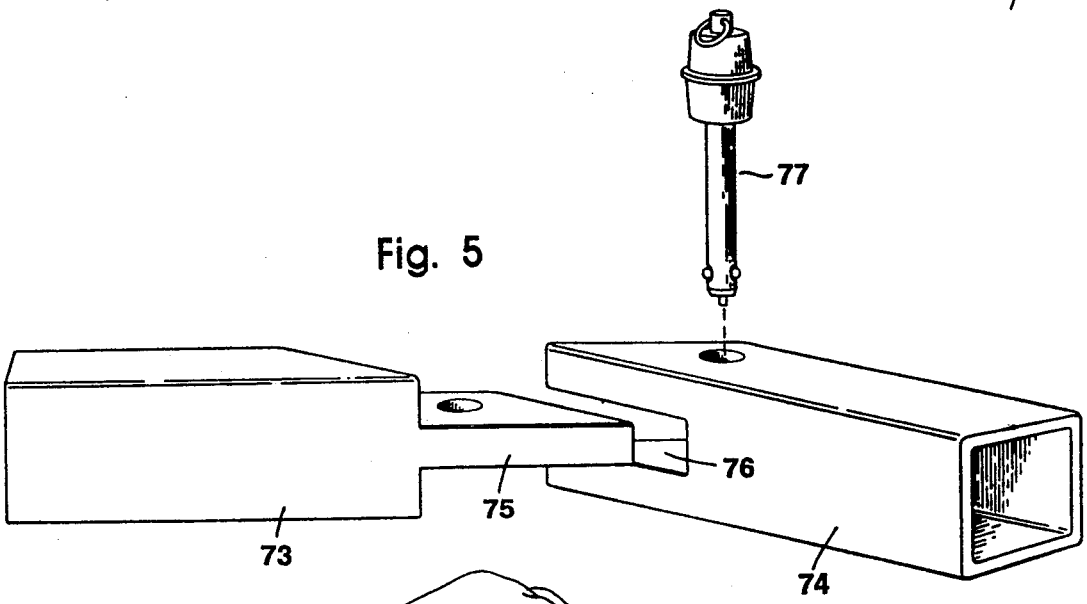
FIG. 5 is a perspective view of detail of the latch assembly of the embodiment of FIG. 2.

Adjacent one handle socket a female hose fitting 70 is welded in place on the ring to provide a means for attaching the end of an ordinary garden hose 22 nominally of $\frac{5}{8}$ or $\frac{3}{4}$ inch diameter, to supply the necessary flow of water. The water inlet may further be provided with a valve to allow the water flow to be readily controlled by the user.

Where it may be desirable to have a ring which can be opened to pass over, for example, a person lying on a stretcher, the ring can be provided with hanging and latching means as shown in FIGS. 2, 5, 6, 8, 9 and 10. The latch assembly 71 of FIGS. 5 and 6 is preferably positioned at one corner of the octagonal ring, adjacent to the inlet fitting, to allow complete separation of the respective tubing sections **20*a* and 20*b* which meet at that point. The end of each tube is capped with a short length of solid aluminum 73 and 74 respectively. One such cap is shaped with a flat central extension 75 which fits snugly into a mating central slot 76 within the other cap. A spring biased removable clevis pin 77** passes through aligned holes in each cap to lock the tubing ends together. A relatively tight fit of the respective parts is desirable to prevent any looseness or play in the ring itself.

A hinge assembly as shown in FIGS. 8 and 9 is similarly constructed and is positioned at a diametrically opposite corner of the ring from the latch assembly. The ends of the female slot 78 and male extension 79 of the respective solid aluminum end caps 81 and 82 are provided with sufficient clearance at all points to avoid any binding or interference between parts during hinge movement. A smooth shank bolt 83 serves as a permanent pivot in contrast to the removable clevis pin of the latch assembly and is fixed in place by a nut at one end. The pivot is provided with Teflon plastic washers 84 at each interface between relatively movable parts to reduce friction and facilitate the hinge operation.

The hinge assembly also includes a bypass means to conduct water from one tube portion to the other, comprising a short flexible hose portion 85 secured to hose fittings at the respective tube ends. The alternative bypass assembly shown in FIG. 10 provides a structure which serves as both an inlet fitting and a flexible hinge bypass. A water supply hose is attached to the inlet of an ordinary "Y" connector 86 which is situated between and connected to flexible hose portions which are attached to the respective tube portions. The Y-connector may further be provided with outlet valves to allow the water flow to be selectably directed to the respective sections of the spray ring. The hose connections of FIGS. 2, 8 and 10 allow the two half-octagonal or half-ring closed-end tubing sections **20*a* and 20*b* to be connected to separately controlled sources of cleaning liquid by using a supply hose connected to the hose fitting on section 20*a* of FIG. 8 and capping the adjacent hose fitting on section 20*b*, the latter being supplied by hose fitting 70 as in FIG. 2. Removal of the pin 77 and bolt 83 seen in FIGS. 5 and 9 enables these sections 20*a* and 20*b*, each of which has its own handle socket 64, to be to be completely separated and used independently of each other. These quickly detachable connections also facilitate packing the separated half-rings 20a and 20b** compactly for storage.

The inner dimensions of the spray ring are such that it not only may be readily passed over a person who is wearing a hazardous material protective suit with self contained breathing apparatus, but it may also be readily passed over a standard fifty-five gallon drum 88 as shown in FIG. 11 or over an "overpack" drum which is slightly larger than a fifty-five gallon drum and intended to encase such a drum which may be leaking or otherwise need more encasing protection.

The weight of a spray ring with two attached extensible handles when unconnected to a hose and empty of water is approximately seven pounds. The addition of water within the ring increases its weight by approximately three pounds.

Normal water pressure from a typical city water system is of the order of 30 pounds per square inch (psi) at the tap an it is preferable and beneficial to use a higher pressure by providing the water from an engine pump outlet so that decontamination may take place at 50 psi. or higher with a maximum never exceeding 150 psi.

Figure 13:
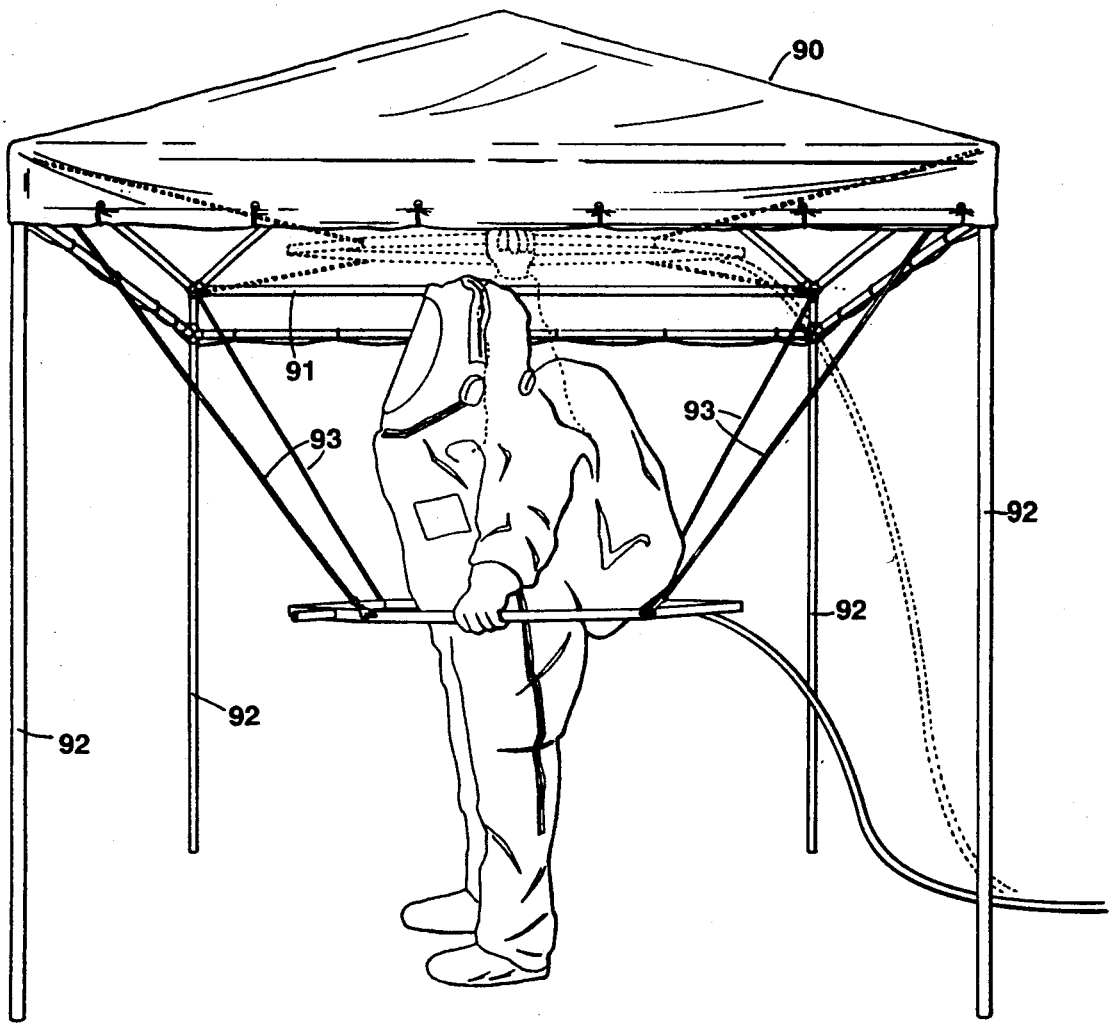
FIG. 13 is a perspective view showing a tent-like structure used to cover a single decontamination station with a spray hoop mounted horizontally by elastic cords from the tent frame corners and movable vertically by an individual over his or her body without assistance.

In inclement and windy weather it is desirable to enclose the area in which decontamination spraying is being done. This may be achieved by providing a tent-like structure 90, shown in FIG. 13 with conventional tent walls removed or rolled up and the pool 12 omitted, with an inner aluminum metal frame having four vertically extending corner members 92 from which the spray ring may be supported at an elevation approximately 6 feet above the floor by elastic bungee cords 93 at four corners of the ring and which have sufficient elasticity to allow the ring to be grasped by a person standing at the center of the tent and pulled down to approximately floor level to dilute any hazardous materials on the person or his protective suit. The bungee cords are attached by means of hooks on their ends to the ring 20 and to the tent frame and are supported at an elevated level of approximately 7 feet above the floor on the tent frame corner members 92 which are at the corners of an 8 by 8 foot square. The bungee cords are of equal lengths and are attached to uniformly spaced points around the periphery of the spray ring by hooks which preferably engage small rings or eyes attached to the tent frame and to central points of four uniformly spaced sides of the octagonal spray ring. Although the bungee cords can be arranged to have their hooks fastened around uniformly spaced spray ring corners where adjacent sides of the ring meet, the ends of the cords are then farther from the center of the rings and the initial length of the cords is somewhat shorter. This results in less of a length of cord to stretch during movement of the spray ring from its elevated position to the floor position. The attachment points at the upper corners of the tent frame are sufficiently outward of the spray rings so that the lengths of the cords can be made with elasticity to allow the rings to be moved from head to foot and returned to their uppermost position when the downward pull of the user is released and the user has merely to guide the ring back to its upper position as it is pulled back automatically by the elastic force of the bungee cords. The bungee cords themselves are made from ¼ inch "shock cord" material having a nominal elongation of approximately 300%.

The spray ring of the present invention provides a concentrated and essentially uniformly inwardly directed planar pattern shown in FIGS. 1, 7 and 11 which can achieve an adequate dilution effect when being passed over a person or an object while using only approximately 8 gallons per minute (gpm) of liquid dispensing. A typical hand held nozzle previously used for dilution dispenses approximately 10 to 15 gpm. and cannot provide the spraying from all directions as in the case of the present invention.

The inner handles 95 shown in FIG. 1 for self manipulation of the spray ring are metal handles which have a knurled outer surface to facilitate gripping and manipulating the spray ring.

Figure 20:
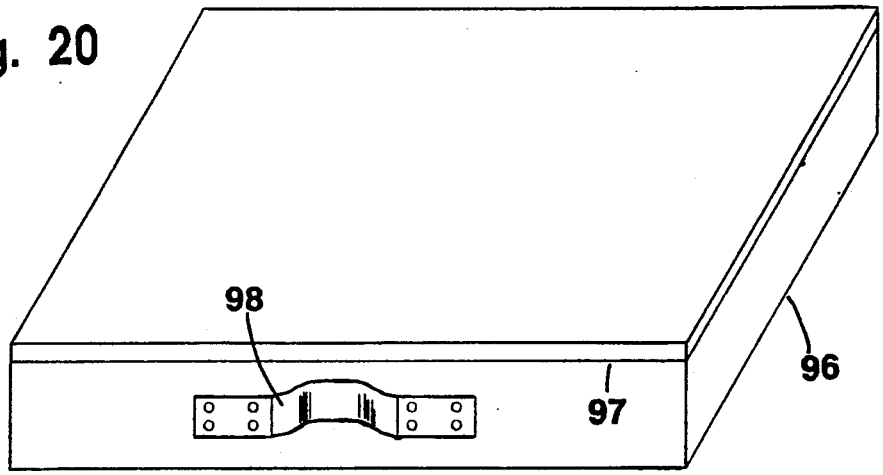
FIG. 20 is a perspective view of a bag for a kit of spray equipment.
Figure 21:
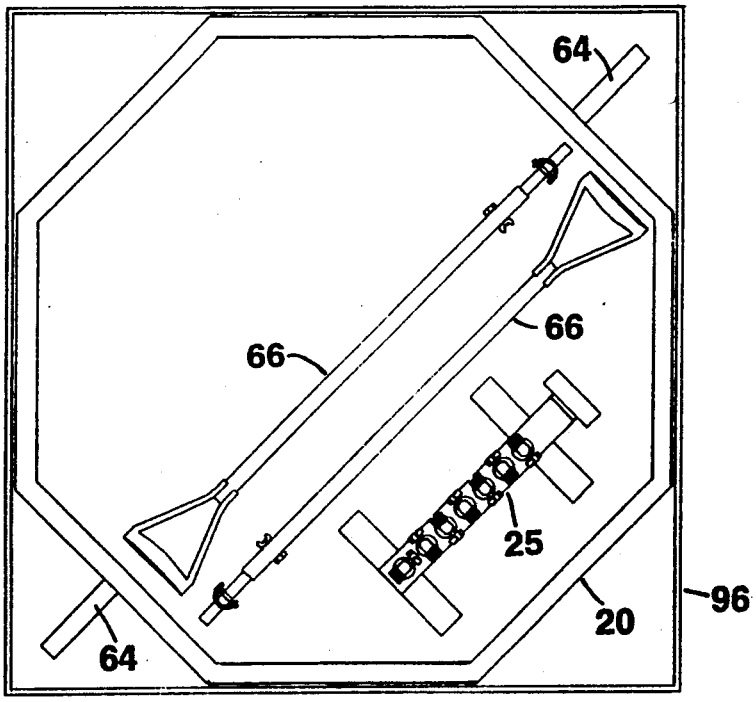
FIG. 21 is a plan view of the container of FIG. 20 with its top removed and showing spray equipment therein.

As seen in FIGS. 20 and 21, a kit containing six stacked spray rings 20, six sets of extensible handles 60 and a manifold 25 may be conveniently packed in a square bag 96 having its squared dimensions corresponding to or just slightly larger than a 48 by 48 inch square defined by a set of four alternate sides of the octagonal rings. FIG. 20 shows the bag with a top closure removably secured thereto by any suitable means such as a peripheral zipper 97 around its four sides. Suitable carrying handles 98 may be attached to opposite sides of the bag 96. FIG. 21 shows the bag 96 with its top closure removed, exposing the contents which may be secured in place within the bag by any suitable means such as straps (not shown). The sides of the spray rings to which the bungee cord rings and the 6 inch long handle attaching members 64 are secured are preferably arranged so that these sides are inclined to the sides of the bag 96 and extend across the corners within the bag with the rings or handle attaching members 64 pointing generally toward the corners of the bag 96.

Since each spray ring 20 is made of square tubing with its flat surfaces parallel to and perpendicular to the plane of the ring, the flat faces which are parallel to this plane can rest on upon another in the stack of six rings to facilitate stacking them in the carrying case 96. It should be further noted that the outward extensions 64 for the connection of the handles are located in the middle of opposed sides of the octagon and do not extend beyond a point corresponding to a square corner of the retaining bag 96 for the kit. All of the handles 66 and the manifold 25 may be stored in the central area of the six stacked rings within the bag 96, as seen in FIG. 21.

The pools 12 used as shown in FIG. 12 may be of any desired configuration providing they will retain a specified quantity of water. For larger capacities it may be desirable to provide a rigid frame for containing a flexible waterproof liner of desired capacity.

If the nature of the hazardous material is known, a system similar to the soap dispensing system may be used with an appropriate solution therein to neutralize or counteract the effects of the hazardous material which is being removed from the person or suit being treated. If desired the ring may be used to spray only material from the auxiliary container without any flow of water from the primary line to the ring by selectively shutting off any of the valves 31–36. In the case of treating a patient on a stretcher or backboard, or other elongated object to be treated, spraying can be done by two persons who carry the patient on the board or stretcher to a pair of saw horses which are spaced to support the ends of the stretcher or board. Before placing the patient for support by the two saw horses a spray ring is dropped over one of the horses. Thereafter the patient is placed for support by the horses and the ring can be raised and passed from end to end over the patient for dilution of any hazardous materials on the patient. The ring can be dropped over the second of the two saw horses or returned to its initial position around the base of the first horse.

Other variations within the scope of this invention will be apparent from the described embodiment and it is intended that the present descriptions be illustrative of the inventive features encompassed by the appended claims.

What is claimed is:

1. A flat spray ring device for removing hazardous materials including toxic, caustic or flammable materials from an exterior surface of an object or of a person comprising a manually supportable ring of tubing to conduct a cleaning liquid therein around its periphery, said ring being flat and lying between two parallel planes defined by opposite surfaces of the ring which define its thickness, said tubing having a surface facing radially inwardly generally toward the center of the ring, said ring device having only several holes and only several nozzles for discharge of cleaning liquid, said nozzles being attached to said tubing at said holes and located on and spaced around said surface and being inwardly oriented to direct their discharge in spray patterns toward the center of the ring, each nozzle having a centerline of its spray discharge pattern pointing essentially at a point centrally of the ring which is between said two planes, the spray patterns of the several nozzles being flat fan-patterned generally in the plane of the ring and providing a low rate of flow in a concentrated flat essentially peripherally continuous spray pattern on the surface of said object or person for impingement of cleaning liquid at all outwardly exposed surfaces of said object or person between said two planes, liquid connection means extending outwardly from the ring generally in the plane thereof for connecting a liquid supply hose to the ring, said device including means for manually supporting it during a cleaning operation, the maximum thickness of said device being essentially the same as the thickness of said ring tubing, the inside of the ring being large enough to encircle and enable spraying of the outer cylindrical surface of a standard fifty-five gallon drum, whereby the effluent cleaning liquid containing removed hazardous material is kept to a low quantity.

2. A hazardous material cleaning device according to claim 1 wherein said ring is shaped with at least one pair of straight opposite sides which can be grasped by a user to raise and lower the ring about the user's body.

3. A hazardous material cleaning device according to claim 1 wherein said ring is a regular polygon having its sides connected at each corner thereof to form an obtuse angle at the inside of the ring and in the plane thereof.

4. A hazardous material cleaning device according to claim 3 wherein said ring is a regular octagon, the distance across outer straight sides thereof being approximately 48 inches and the ring thickness being about 1 inch.

5. A hazardous material cleaning device according to claim 1 wherein said ring is a regular octagon.

6. A hazardous material cleaning device according to claim 1 wherein said ring is provided with at least one straight side which can be rested on the ground to provide non-rolling stability during use while a user grasps the side of the ring generally opposite the side resting on the ground.

7. A hazardous material cleaning device according to claim 1 wherein said ring is polygonal in the shape of a regular polygon with a plurality of straight sides which can be selectively rested on the ground to provide non-rolling stability during use while a user grasps the side of the ring generally opposite the side resting on the ground, said polygonal ring having its sides connected at each corner thereof to form an obtuse angle at the inside of the ring and in the plane thereof.

8. A hazardous material cleaning device according to claim 1 wherein said ring is made from square tubing having flat top and bottom surfaces parallel to the plane of the ring.

9. A hazardous material cleaning device according to claim 1 wherein said ring has two relatively pivotably connected sections which move relative to each other generally in the plane of the ring to open the periphery of the ring, said sections both being connected to said liquid supply means, each of said sections including a plurality of said several inwardly directed nozzles.

10. A hazardous material cleaning device according to claim 9 wherein separate valve means are provided to separately control flow of cleaning liquid to said two ring sections respectively.

11. A device according to claim 9 wherein said ring is provided with a latch structure and a hinge structure interconnecting said sections to allow said ring to be opened and latched closed.

12. A device according to claim 1 wherein said ring is provided with two sockets which extend outwardly generally in the plane of the ring and are diametrically opposed to each other, each socket being capable of receiving an end of an elongated handle so the device may be supported or moved for dilution spraying by one or two people using such handles to keep them at a distance from the ring.

13. A hazardous material cleaning device according to claim 12 including a readily manually detachable adjustable length telescoping handle received in at least one of said sockets.

14. A device according to claim 1 wherein said ring is octagonal and is provided with two sockets which extend outwardly from the centers of two opposed sides of the ring generally in the plane of the ring and are diametrically opposed to each other, each socket being capable of receiving an elongated handle so the device may be supported or moved by one or two people during use to keep them at a distance from the ring.

15. A hazardous material cleaning device according to claim 14 including a readily manually detachable adjustable length telescoping handle received in at least one of said sockets.

16. A kit comprising six hazardous material cleaning devices according to claim 14 and including a generally rectangular bag closely enclosing the six rings of said devices in a stacked relationship and including centrally within the stacked rings two telescoping handles for each such ring.

17. A portable decontamination system including at least one station having a cleaning device according to claim 1, a portable manifold structure having an inlet port for connection to a fire hose for supply of cleaning liquid to the manifold, said manifold having a plurality of individually controlled horizontally and laterally facing outlet means for separable connection to a plurality of such cleaning devices and including one such outlet means for each said cleaning device at an included station, each said outlet means including a manually adjustable valve for controlling flow of said cleaning liquid from said manifold, and separate individual flexible hose means for connecting each said outlet means to the liquid connection means of the respective cleaning device, said manifold including means for supporting said manifold in a stable position on a horizontal supporting surface and with said fire hose connection and said outlet means spaced above said surface to facilitate attaching said fire hose and each of the flexible hose means to the outlet means of the manifold.

18. A decontamination system according to claim 17 wherein said manifold includes a plurality of outlet means each having an adjustable valve thereat for stopping flow of liquid therethrough when no cleaning device is connected to the respective outlet means.

19. A decontamination system according to claim 17 wherein the inlet port of said manifold comprises a fitting having a relatively rotatable connection with the manifold and two different sized large diameter and small diameter concentric coaxial female threaded fitting connections which enable said manifold to be directly connected to male threads of one or the other of two conventional fire hoses having two corresponding different sized threaded male fittings, the threads of the small diameter female threaded connection being radially and axially within, and of lesser axial length than, the threads of the large diameter threaded connection, said rotatable connection enabling rotation of said manifold fitting relative to the manifold to allow threading of the fitting onto a selected fire hose connector fitting without rotating said manifold, said relatively rotatable fitting including means to prevent external leakage of cleaning liquid at said connections when the manifold is connected to a fire hose at either of the female threaded connections.

20. A decontamination system according to claim 17 including a plurality of such stations.

21. A decontamination system according to claim 17 including two sets of such stations with each station connected to a different outlet means of said manifold, the outlet means for one set of stations being oriented on said manifold to readily distinguish those outlet means for that one set from the outlet means for the other set of stations.

22. A decontamination system according to claim 17 further including a soap dispensing container having an outlet means connected to a soap-using ring device at a cleaning station, direct supply means to connect said soap using ring device to an outlet means on said manifold to supply said cleaning liquid to said soap using ring device, means including a separate outlet means on said manifold connected for supplying cleaning liquid to said soap container to displace soap therefrom to the soap container outlet, and valve means for independently controlling the flow of liquid through said soap container from the separate outlet means at the manifold to control the amount of soap supplied to the soap-using ring device independently of the supply of cleaning liquid from said direct supply means to the soap-using ring device.

23. A decontamination system including at least one station having a cleaning device according to claim 1 wherein said device at said one station is supported in a generally horizontal position by elastic means allowing it to be manually grasped at said means for manually supporting the device and pulled downward against said elastic means by a using person standing therebeneath to various manually determined positions around the using person for dilution spraying at varying heights from all horizontal directions from the ring toward the using person, said elastic means providing return of said device to said horizontal position upon release of the downward pull by the person.

24. A decontamination system according to claim 23 wherein said elastic means comprises a set of elastic cords.

25. A decontamination system according to claim 24 including a frame supported above and outwardly from the spray ring for supporting the upper ends of said elastic cords whereby the cords extend upwardly and outwardly from the ring.

26. A decontamination system according to claim 25 wherein said frame is part of a tent-like structure.

27. A decontamination spraying system comprising a large collecting pool with a large horizontally extending area, a plurality of dilution spraying stations within said area, each station having a separate smaller collecting pool and an associated spraying device according to claim 1.

28. A decontamination system according to claim 27 wherein said large collecting pool is a flat shallow pool having a peripheral liquid retaining means formed by a water-impervious sheet completely covering a looped fire hose and wherein the fire hose raises the sheet around the pool to retain liquid therein.

29. A hazardous material cleaning device according to claim 1 wherein each said nozzle has a spray pattern spreading toward the center of the ring device throughout an angle of approximately 80 degrees in the plane of the ring device, but has a pattern which is flattened and is of substantially less angular extent toward the center of the spray ring in a plane normal to the plane of the ring device.

30. A hazardous material cleaning device according to claim 1 wherein each said nozzle has a wide spray pattern in the plane of the ring device but a relatively narrow spray pattern in a plane normal to the plane of the ring device confined primarily to the space within the thickness of the ring device.

31. A hazardous material cleaning device according to claim 1 wherein each said nozzle has a wide spray pattern toward the center of the ring devce in the plane of the ring device but a relatively narrow spray pattern, in a plane normal to the plane of the ring device, confined to a angle from the nozzle of approximately 2.4 to 4.8 degrees.

32. A liquid conducting device for connecting a water conducting system to male threads of a connector fitting of a conventional fire hose, said device comprising an outlet port means for connection to said system, an inlet port having means including a rotatable fitting having a relatively rotatable connection with the outlet port means to allow threading of said rotatable fitting onto the fire hose connector fitting, without rotating said outlet port means, and two different sized large diameter and small diameter coaxial concentric female threaded fitting connections in the rotatable fitting which enable the device to be directly connected to male threads of one or the other of two conventional fire hoses having two corresponding different sized threaded male fittings, the threads of the small diameter female threaded connection being radially and axially within, and of lesser axial length than, the threads of the large diameter threaded connection, said relatively rotatable fitting including means to prevent external leakage of cleaning liquid at said connections when the device is connected to a fire hose at either of the female threaded connections.

33. A device according to claim 32 forming a manually portable manifold for a portable decontamination system or the like and including means for connecting said outlet port means to a plurality of separate individually valve-controlled outlets for connection to multiple portable spray cleaning devices to control supply of a cleaning liquid thereto for removing hazardous material from an object at one or more spraying stations.

34. A flat spray ring for removing hazardous materials including toxic, caustic or flammable materials from an exterior surface of an object or of a person comprising a manually supportable ring of tubing to conduct a cleaning liquid therein around its periphery, said ring being flat and lying between two parallel planes defined by opposite surfaces of the ring which define its thickness, said tubing having a surface facing radially inwardly generally toward the center of the ring, said ring having only several holes and only several nozzles for discharge of cleaning liquid, said nozzles being attached to said tubing at said holes and located on and spaced around said surface and being inwardly oriented to direct their discharge in spray patterns toward the center of the ring, each nozzle having a centerline of its spray discharge pattern pointing essentially at a point centrally of the ring which is between said two planes, the spray patterns of the several nozzles providing impingement of cleaning liquid at all outwardly exposed surfaces of said object or person between said two planes, liquid connection means extending outwardly from the ring for connecting a liquid supply hose to the ring, said device including means for manually supporting it during a cleaning operation, the inside of the ring being large enough to encircle and enable spraying of the outer cylindrical surface of a standard fifty-five gallon drum, said nozzles being of a size to provide a liquid spray volume of flow of approximately 8 gallons per minute at a pressure of approximately 50 psi.

35. A hazardous material cleaning device according to claim 34 wherein each said nozzle has a spray pattern spreading throughout an angle of approximately 80 degrees in the plane of the ring, but is flattened and is of substantially less pattern width at the center of the spray ring in a plane normal to the plane of the ring.

36. A hazardous material cleaning device according to claim 34 wherein said ring has two separable half-ring sections connected end-to-end and including connecting means whereby the sections are separable relative to each other generally in the plane of the ring to open the periphery of the ring, said sections being separately connectable to said liquid supply means, each of said sections including a like plurality of said several inwardly directed nozzles.

37. A portable decontamination system including at least one station having a liquid spray cleaning device according to claim 34 for cleaning hazardous materials from an exterior surface of an object or of a person, a portable manifold structure having an inlet port for connection to a fire hose for supply of cleaning liquid to the manifold, said manifold having a plurality of individually controlled outlet means for separable connection to a plurality of such cleaning devices and including one such outlet means for each said cleaning device at an included station, each said outlet means including a manually adjustable valve for controlling flow of said cleaning liquid from said manifold, and separate individual flexible hose means for each such included station for connecting the respective outlet means to supply cleaning liquid to the respective cleaning device, said manifold comprising an elongated tube with said inlet port at one end of the tube, means for supporting said tube horizontally on horizontal supporting surface with one side of the tube facing upwardly, said plurality of outlet means extending from the upwardly facing side said tube with outlet connections horizontally oriented toward opposite sides of the manifold structure.

38. A decontamination system according to claim 37 wherein the inlet port of said manifold comprises a fitting having a relatively rotatable connection with the manifold and two different sized large diameter and small diameter concentric coaxial female threaded fitting connections which enable said manifold to be directly connected to one or the other of two conventional fire hoses having two corresponding different sized threaded male fittings, the threads of the small diameter female threaded connection being within, and of lesser axial length than, the threads of the large diameter threaded connection, said rotatable connection enabling rotation of said manifold fitting relative to the manifold to allow threading of the fitting onto a selected fire hose connector fitting without rotating said manifold, said relatively rotatable fitting including means to prevent external leakage of cleaning liquid at said fitting connections when the manifold is connected to a fire hose at either of the female threaded connections.

* * * * *